US005600727A

United States Patent [19]

Sibbald et al.

[11] Patent Number: 5,600,727

[45] Date of Patent: Feb. 4, 1997

[54] DETERMINATION OF POSITION

[75] Inventors: Alastair Sibbald, Maidenhead; Richard Clemow, Gerrards Cross, both of Great Britain

[73] Assignee: Central Research Laboratories Limited, Middlesex, Great Britain

[21] Appl. No.: 271,602

[22] Filed: Jul. 7, 1994

[30] Foreign Application Priority Data

Jul. 17, 1993 [GB] United Kingdom ..... 9314822

[51] Int. Cl.[6] ..... H04R 5/027; H04R 3/00

[52] U.S. Cl. ..... 381/26; 381/92; 381/122

[58] Field of Search ..... 381/92, 26, 122; 367/96, 104

[56] References Cited

U.S. PATENT DOCUMENTS 4,119,798 10/1978 Iwahara .
4,586,195 4/1986 DeGeorge et al. ..... 381/92
4,733,355 3/1988 Davidson et al. ..... 364/424
4,796,726 1/1989 Kobayashi et al. ..... 181/123
5,206,838 4/1993 Kashiwase ..... 367/99

*Primary Examiner*—Forester W. Isen
*Attorney, Agent, or Firm*—Keck, Mahin & Cate

[57] ABSTRACT

An autocalibration system includes two loudspeakers (2, 4) spaced from three microphones (16, 18, 20). Acoustic transient pulses are emitted by each loudspeaker (2, 4) in turn and from the reception of of these pulses by each of the microphones (16, 18, 20), the time-of-flight for each pulse to each microphone may be derived. From these time-of-flight measurements are also derived the distance and angular displacement of each microphone (16, 18, 20) from a reference point (12) flanked by the loudspeakers (2, 4).

7 Claims, 6 Drawing Sheets

DETERMINATION OF POSITION

The present invention relates to a method and apparatus for determination of position and has particular, although not exclusive, relevance to use in so-called dummy-head recording techniques.

An example of a dummy-head recording system is disclosed in U.S. Pat. No. 4,119,798. In this document a dummy-head having microphones mounted in the ear canals thereof is used for multi-channel stereophonic sound recording. An acoustic cross-talk cancellation circuit is arranged to receive the microphone signals thereby to provide a binaural effect when reproduced through loudspeakers.

There are circumstances, though, in which the use of further microphones remote from the dummy-head may be used as part of the recording process to provide a binaural effect. In such a situation it is necessary to know accurately the position of each remote microphone relative to the dummy head.

There exist a variety of methods by which this position may be measured, such as using polar coordinates by utilising a theodolite and an optical range finder. Alternatively the Cartesian coordinates of the remote microphones and dummy head could be measured with respect to the boundaries of the room in which the recording is to take place, and then the azimuth angle, depression/elevation angle and the time-of-flight distance between the dummy-head and each remote microphone could be calculated.

However such methods of measurement suffer from various shortcomings including the fact that distance measurements take a considerable time to carry out and are often very disruptive in a recording environment, especially if the remote microphones are deliberately moved to a different location during a recording session. Also the calculations based upon the measurements made are prone to cumulative errors, particularly for extreme positions where the angles subtended may be very small.

Furthermore remote microphones may be physically difficult to access for measurement purposes due to being suspended several meters from the ground above an orchestra, for example.

Another problem exists due to the fact that the time-of-flight between the remote microphones and the dummy-head is dependent on the speed of sound in air, which is itself dependent on both air temperature and humidity.

It is thus an object of the present invention to at least alleviate the above-mentioned shortcomings by providing a method and apparatus for positional determination in which the need for physically measuring angles and distances is avoided.

Thus, according to a first aspect of the present invention there is provided a method of determining the position of a receiver relative to a given reference point comprising:

transmitting signals from each of a plurality of signal generators;

receiving transmitted signals at the receiver;

measuring the time-of-flight of the signals from each signal generator to the receiver;

and geometrically determining, from the time-of-flight measurements and the position of the given reference point relative to each signal generator, the distance and angular disposition of the receiver relative to the given reference point. This provides an advantage that an autocalibration technique is achieved which, inter alia, inherently takes account of any variations in ambient conditions.

Preferably the signals transmitted from each of the signal generators are transient pulses. Furthermore the signals may be transmitted from each of the plurality of signal generators in turn.

According to a further aspect of the present invention there is provided an apparatus for determining the position of a receiver relative to a given reference point comprising:

a plurality of signal generators for transmitting signals therefrom;

a signal receiver for receiving the transmitted signals;

and a signal processor for measuring the time-of-flight of the signals from each signal generator to the receiver and geometrically determining, from the time-of-flight measurements and the position of the given reference point relative to each signal generator, the distance and angular disposition of the receiver relative to the given reference point.

The present invention will now be described, by way of example only and with reference to the following drawings, of which:

Figure 1:
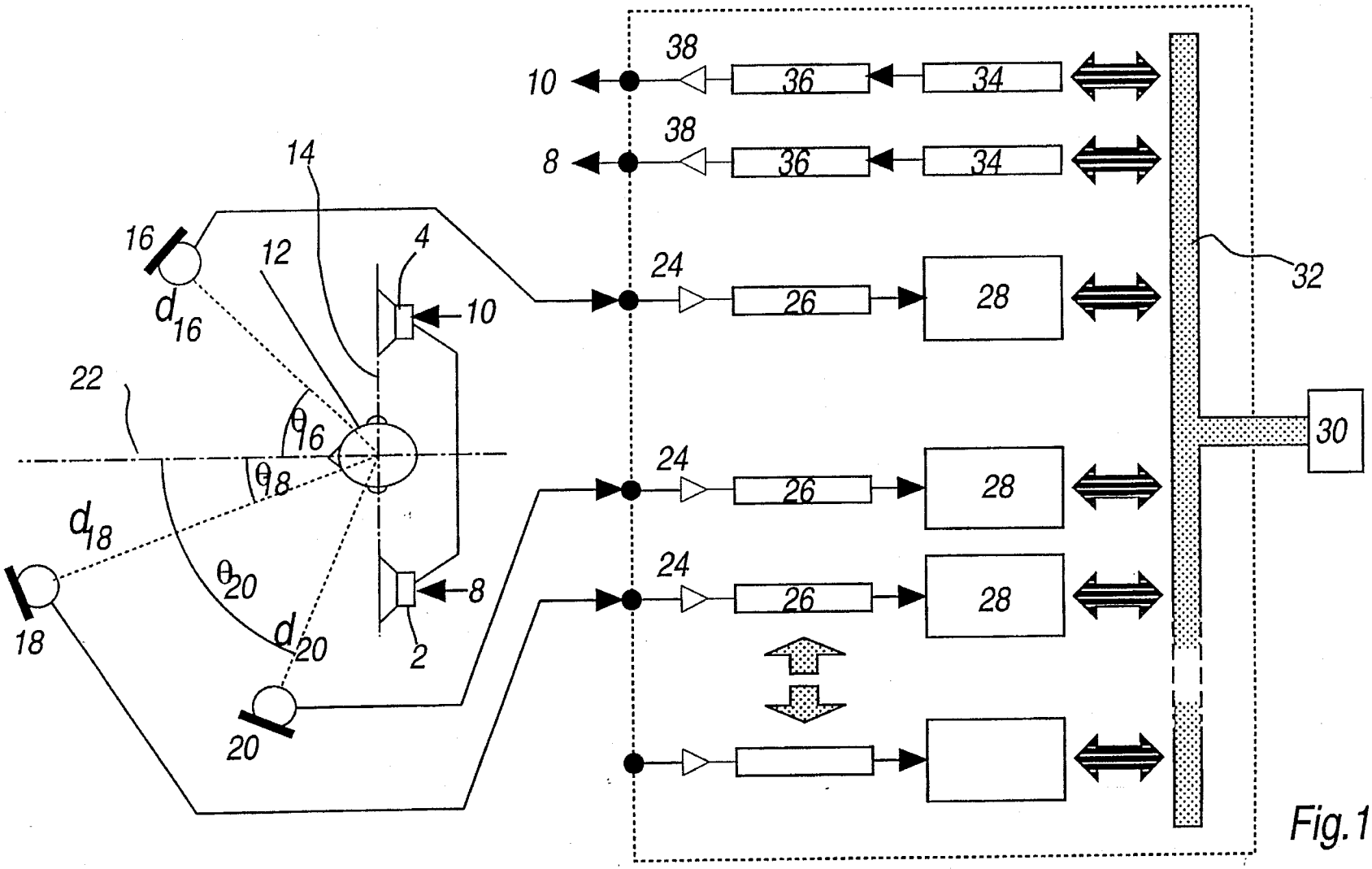
FIG. 1 illustrates schematically an autocalibration system in accordance with the present invention.

Referring firstly to FIG. 1, a two-dimensional autocalibration system for a multi-microphone array in accordance with the present invention is illustrated in which all microphones and loudspeakers lie in the same plane. Two signal generators, in this case loudspeakers 2, 4 which are physically coupled via mounting bracket 6, are fed with transient pulses via their respective drive inputs 8, 10.

It can be seen that the loudspeakers 2, 4 are placed one on either side of a dummy-head 12 such that the lateral centre-line 14 through the dummy-head 12 (i.e. through both ears from one side to the other) and the loudspeakers 2, 4 lie in the same plane.

Three receivers, in this case microphones 16, 18, 20 whose positions in relation to the dummy-head 12 are to be determined are disposed in front of the head 12 and situated at unknown azimuth angles $\Theta_{16}$, $\Theta_{18}$ and $\Theta_{20}$ respectively to the centre-line 22 through the head 12 from its back to its front. Furthermore each microphone 16, 18, 20 lies at an unknown distance from the centre of the head 12 (the latter defined by the point of intersection of the two centre-lines 14 and 22); $d_{16}$, $d_{18}$ and $d_{20}$ respectively.

Each microphone 16, 18, 20 feeds into a respective preamplifier 24 and then into a respective high-precision analogue-to-digital (A/D) converter 26 after which the digitised signal is transferred into a local memory store 28 under the control of a signal processor 30 which communicates via control data bus 32. Each memory store 28 is capable of storing 200 ms of data at a rate of 44.1 kbits per second. The control bus 32 also drives, in parallel, a pair of buffers 34 each of which is coupled to a respective digital-to-analogue (D/A) converter 36 and thence to a power amplifier 38. These power amplifiers 38 are, in turn, coupled to the respective drive inputs 8, 10 of the loudspeakers 2, 4.

Figure 2:
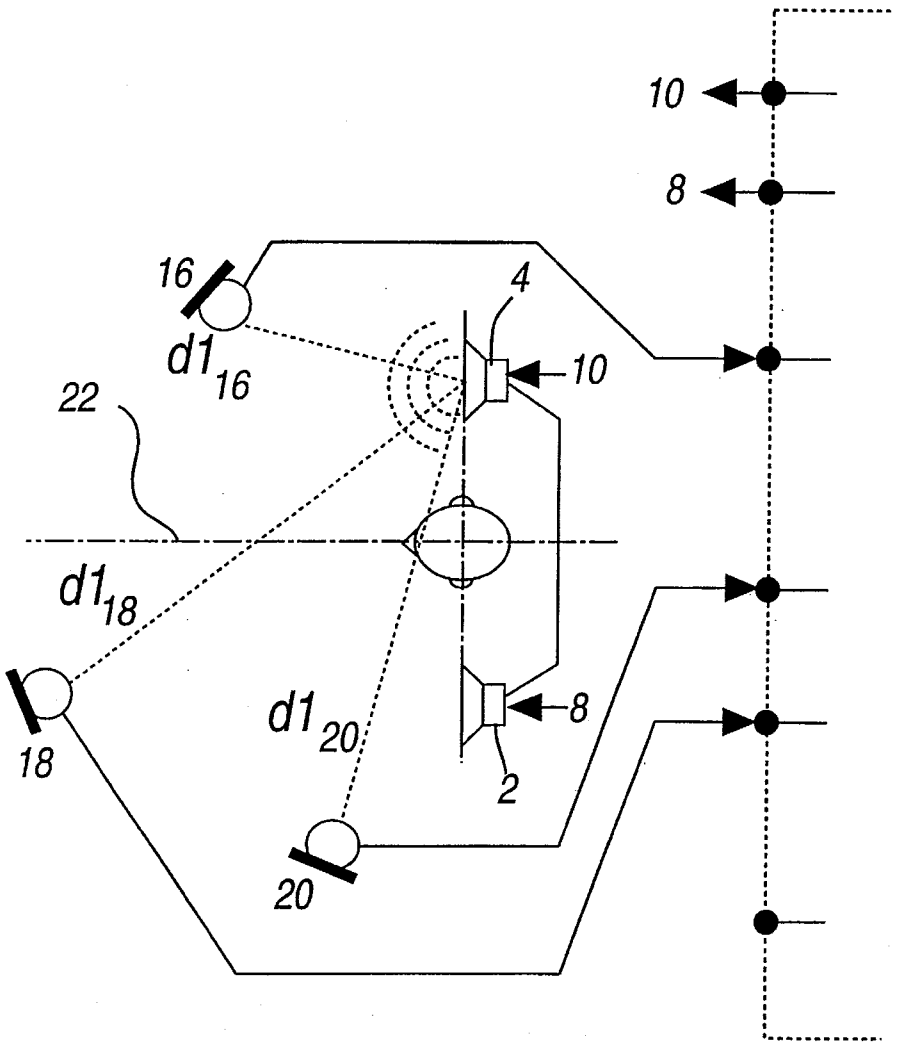
FIG. 2 shows a schematic representation of signal transmission by the right loudspeaker of the autocalibration system of FIG. 1.

The autocalibration system functions as follows. Referring now also to FIG. 2, a signal, here a transient pulse, is generated (in known manner) by the signal processor 30 and sent to the drive input 10 of the (right) loudspeaker 4 via the control bus 32 and the corresponding buffer 34, D/A 36 and amplifier 38. Simultaneously, the outputs of all the microphones 16, 18, 20 are transferred at a constant rate into their respective memory stores 28 via their respective preamplifiers 24 and D/As 26. These outputs are transferred to their respective memory stores 28 only for a pre-determined period, typically 100ms (or until the stores 28 are full), thus forming a temporary, time-domain record of their activity.

One by one, the record of activity of each microphone 16, 18, 20 held within each respective memory store 28 is inspected by the signal processor 30 via data bus 32. This allows detection of the time location of the received transient pulse transmitted by the (right) loudspeaker 4 with respect to the beginning of the record (i.e. at the instant at which the pulse was propagated). Thus the time difference between the transmission of the pulse by the loudspeaker 4 and the time of arrival of the pulse at each microphone 16, 18, 20 can be determined by the signal processor 30. These transit times are known as the time-of-flight of the transit pulse from the loudspeaker 4 to each of the microphones 16, 18, 20.

Each transit distance $d1_{16}$, $d1_{18}$, $d1_{12}$ can be calculated directly from the corresponding time-of-flight measurement $t_{16}$, $t_{18}$, $t_{20}$ and the velocity of sound in air at room temperature and humidity ($\approx 343\ ms^{-1}$) using the relationship:

$$d=vt$$

where v=velocity of sound in air.

Thus, for FIG. 2, the three microphones 16, 18, 20 are located, respectively, at distances $d1_{16}$, $d1_{18}$, $d1_{20}$ from the loudspeaker 4, given by:

$$d1_{16}=vt_{16},\ d1_{18}=vt_{18} \text{ and } d1_{20}=vt_{20}.$$

Figure 3:
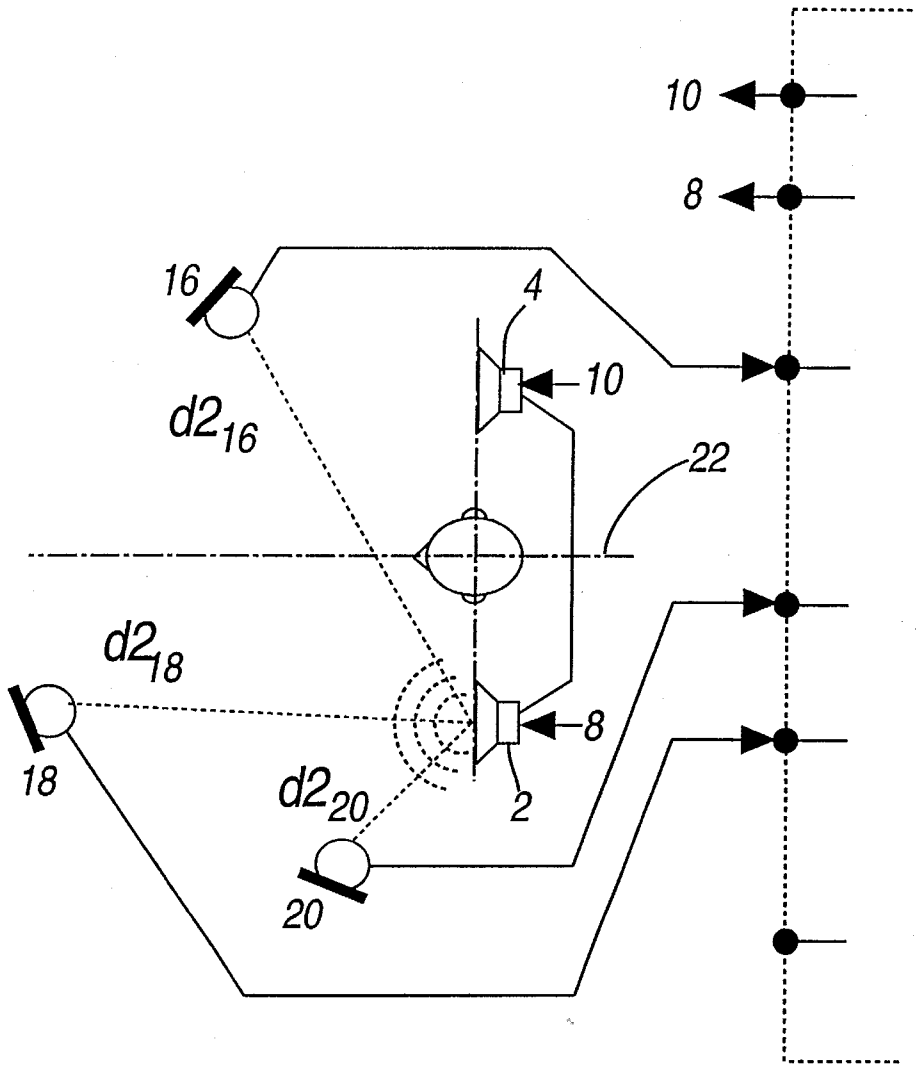
FIG. 3 shows a schematic representation of signal transmission by the left loudspeaker of the autocalibration system of FIG. 1.

Referring now to FIG. 3 the above operation, described with reference to FIG. 2, is repeated using the (left) loudspeaker 8. This operation thus yields corresponding transit distances $d2_{16}$, $d2_{18}$, $d2_{20}$ for the microphones 16, 18 and 20 respectively.

Figure 4:
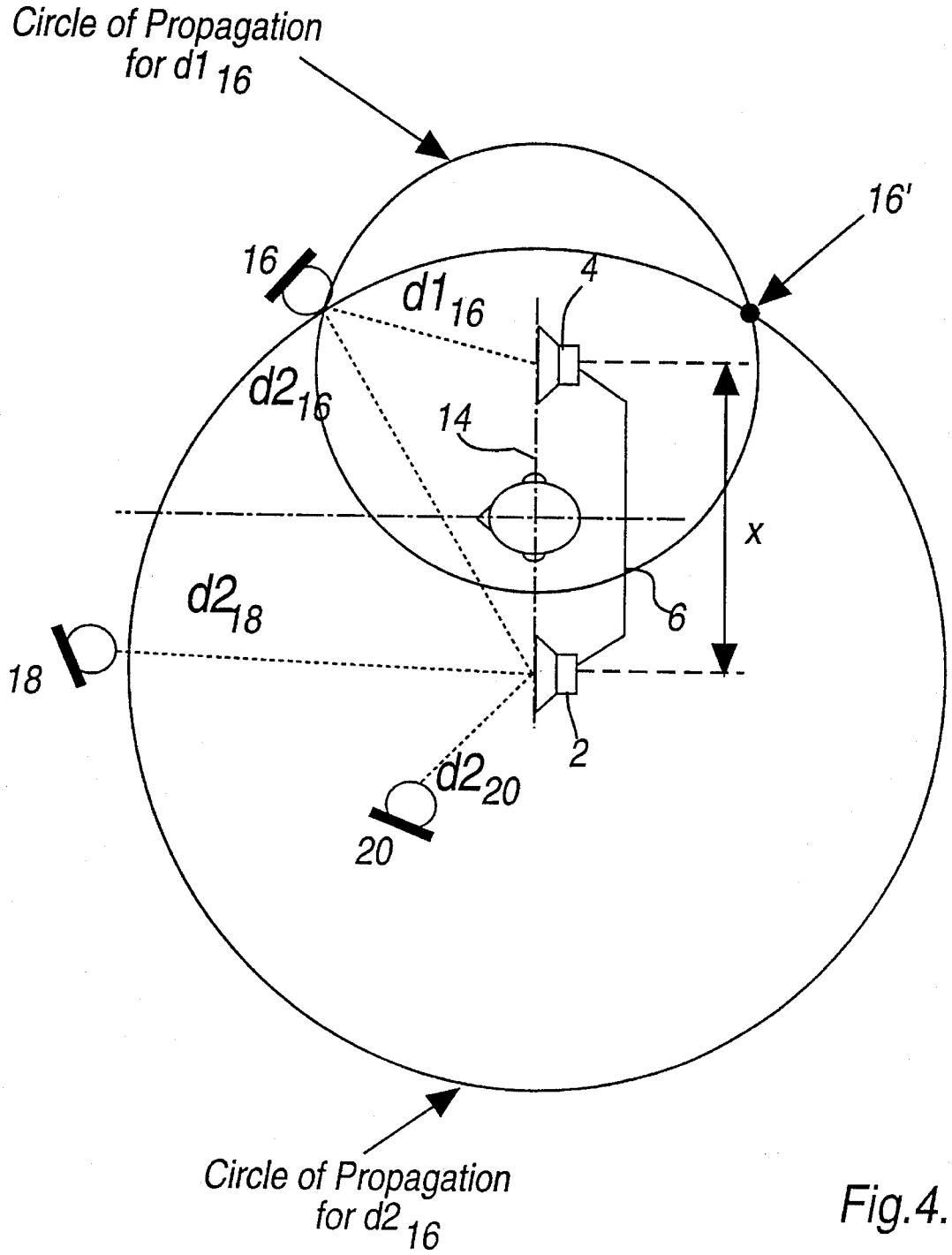
FIG. 4 illustrates schematically how circles of propagation for the fight loudspeaker are constructed.

The location of each microphone 16, 18, 20 with respect to the dummy-head 12 can now be determined. Referring to FIG. 4, if a circle having radius $d1_{16}$ is constructed around a centre which is the loudspeaker 4, then the circumference of this circle represents the location of the wavefront, emitted from the loudspeaker 4 at a time when the microphone 16 registered it.

Similarly, the larger circle in FIG. 4, of radius $d2_{16}$ is constructed around a centre which is the loudspeaker 2. This circle corresponds to the "circle of propagation" from the loudspeaker 2 to the microphone 16. Hence, the microphone 16 must lie at the intersection of both circles, as shown. (It can be seen from FIG. 4 that, by symmetry, the microphone could also lie at $16^1$, but it is known already that all three microphones 16, 18, 20 actually lie in front of the head 12 and so this "ghost" position can readily be discounted. In any event, this "ghost" can be removed simply by use of an additional loudspeaker set away from the plane of loudspeakers 2 and 4). Similar procedures are used to locate the positions of microphones 18 and 20.

Figure 5:
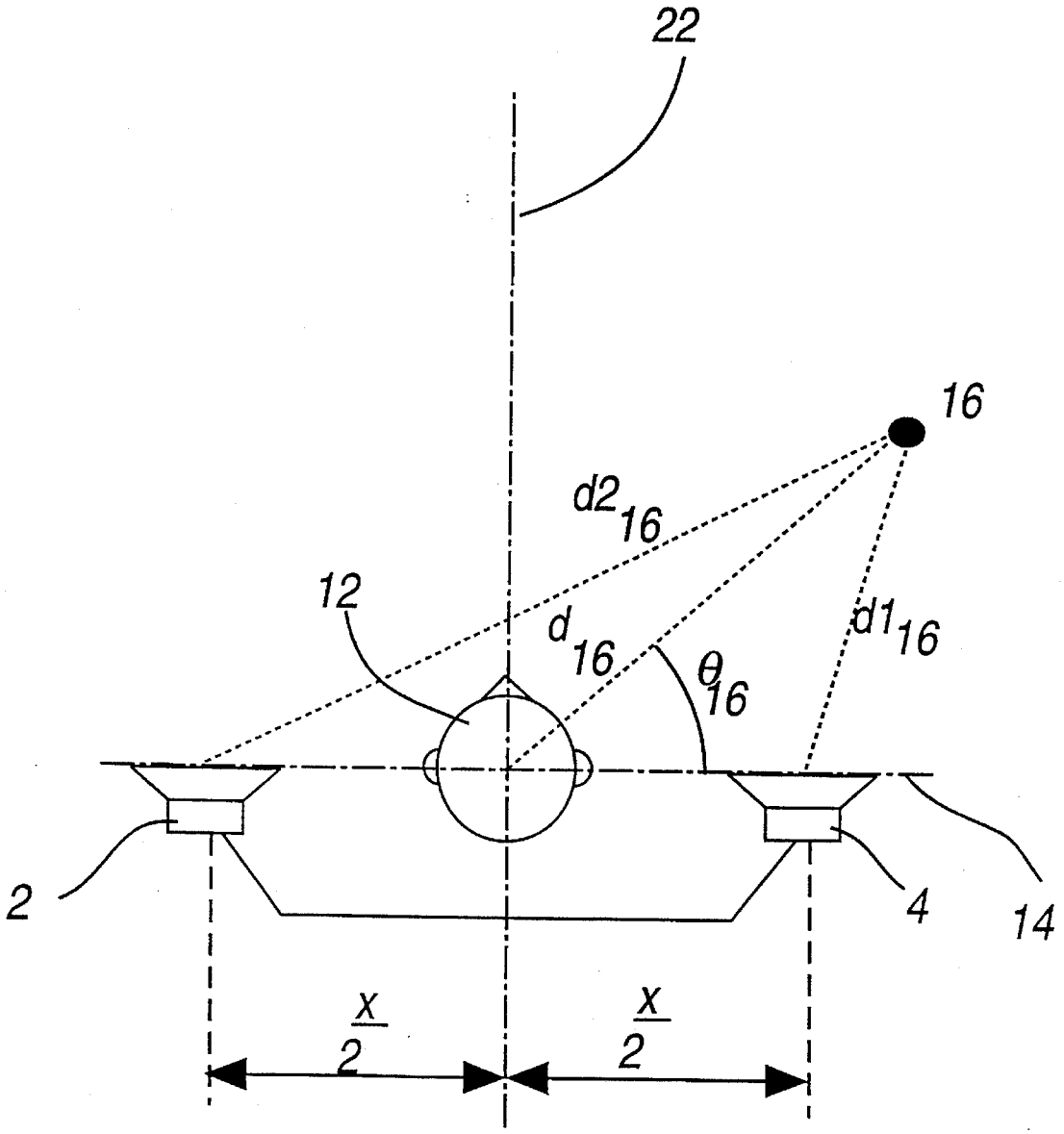
FIG. 5 illustrates schematically how the position and angular displacement of a microphone is determined.

Referring now also to FIG. 5 it is possible, from the transit distances calculated as described above, to determine the angular disposition, θ, of each microphone 16, 18, 20 with respect to a given reference point. In this example the given reference point is the centre of the dummy-head 12 defined by the points of intersection of the centre-lines 14 and 22.

It is necessary to know the separation, x, of the loudspeakers along the centre line 14. Thus the distance of either speaker from the centre of the head 12 is x/2.

Using the law of cosines $d_{16}$ can be derived by:

$$d_{16}=\frac{1}{2}\sqrt{(d1_{16})^2+(d2_{16})^2-x^2}$$

and thus $$\theta_{16}=\cos^{-1}\frac{\left(\left(\frac{x}{2}\right)^2+(d_{16})^2-(d1_{16})^2\right)}{x(d_{16})}$$

Thus both the azimuth angle $\theta_{16}$ and distance $d_{16}$ of the microphone 16 with respect to the dummy-head, as is required. It will be appreciated that, although only the azimuth angle $\theta_{16}$ and distance $d_{16}$ for the microphone 16 have been described, this is for clarity only, and the same trigonometrical treatment is used to find $\theta_{18}$, $\theta_{20}$ and $d_{18}$, $d_{20}$ as well as $d1_{18}$, $d2_{18}$ and $d1_{20}$, $d2_{20}$.

Figure 6:
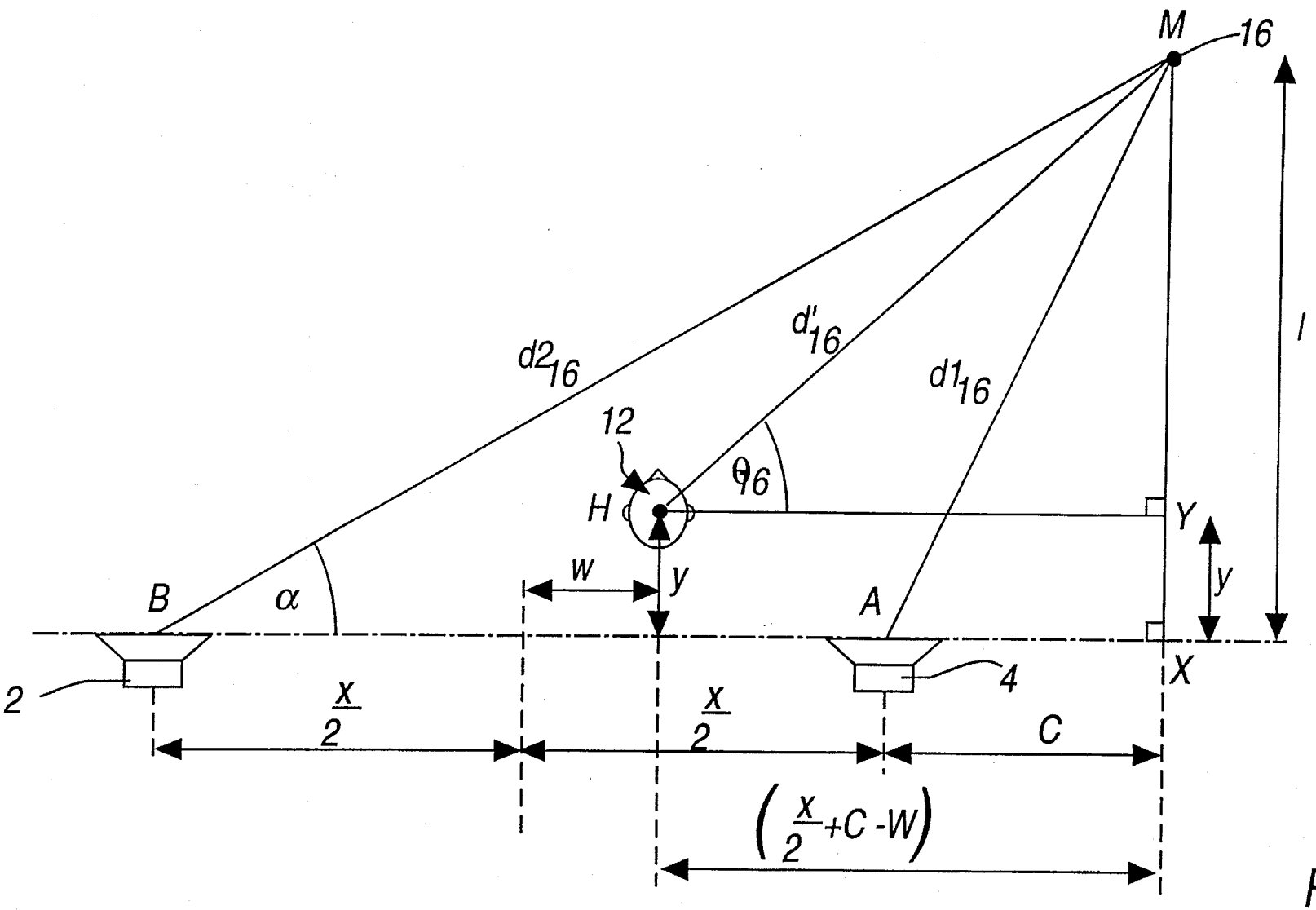
FIG. 6 shows a schematic representation of a second embodiment of the present invention.

Referring now to FIG. 6, the case of determination of the position of the microphone relative to a given reference point, here again the dummy-head 12, when the head 12 does not lie on the line 14 drawn between the two loudspeakers 2, 4 is illustrated.

As in the example described herebefore, the separation, x, of the loudspeakers 2, 4 must be known and the position of the head 12 relative to a point, say the midway between the loudspeakers, also measured. In this figure, the head 12 is at distance w from the midpoint, parallel to line 14 joining the loudspeakers 2, 4 and at distance y from this midpoint in a direction perpendicular to line 14.

As discussed before, the distances x, w and y are known from measurements and the distances $d1_{16}$ and $d2_{16}$ have been calculated from the time-of-flight measurements.

Thus, from the cosine rule on the triangle ABM:

$$d1_{16}^2 = d2_{16}^2 + x^2 - 2\ d2_{16}\ x\ \cos\alpha$$

and from triangle *BMX*: $\cos\alpha=\frac{x+c}{d2_{16}}$ $$\therefore c=\frac{d2_{16}^2-d1_{16}^2-x^2}{2x}$$

and thus the intermediate value, c, may be derived.

Now from triangle BMX:

$$d2_{16}^2 = e^2 + (x+c)^2 \text{ by Pythagoras}$$

which gives $e=\sqrt{d2_{16}^2-(x+c)^2}$ and using Pythagoras on triangle MHY:

$$d_{16}^1=\sqrt{(e-y)^2+\left(c+\frac{x}{2}-w\right)^2}$$

thus $d^1{}_{16}$ may be derived.

Now from triangle MHY:

$$\sin\phi_{16}=\frac{e-y}{d_{16}^1}$$

$$\text{thus } \phi_{16}=\sin^{-1}\left(\frac{e-y}{d_{16}^1}\right)$$

It can be seen, from a consideration of the above examples that the distance and angular disposition of the microphone 16 relative to the head 12 may be determined from a knowledge of the time-of-flight measurements from each loudspeaker 2, 4 to the microphone and the distance measurements between the head 12 and the loudspeakers.

From the foregoing it will be appreciated that the described system in accordance with the present invention automatically takes account of small changes in air velocity with changes in room temperature and humidity due to the fact that the times-of-flight are themselves measured acoustically.

It will be apparent to those skilled in the art that although in the above example three microphones have been shown, there is a lower limit of only one such microphone being necessary and indeed more than three such microphones may readily be employed.

Although the above example teaches using transient pulses transmitted by each loudspeaker in turn, any suitable signals may be used and there is no compulsion for their transmission to be from each microphone in turn. However, when transient pulses are employed, it is convenient for each microphone not to register subsequently received pulses after their first-received pulse from each loudspeaker has been registered. This obviates, for example, registration of stray reflectances from walls or the like.

Those skilled in the art will realise that at least two loudspeakers are needed to implement the present invention. It will also be appreciated that, in the example described hereinbefore a planar system, in which all microphones and loudspeakers be in the same plane is illustrated. It may be convenient, however, for a three-dimensional system to be employed using three loudspeakers, such that not only can the distances and azimith angles of the microphones be derived, but also their angle of elevation (or depresion). Those skilled in the art all appreciate that the geometrical calculations provided hereabove can be extended to encompass the extra dimension.

Those skilled in the art will appreciate that instead of measuring the separation of the loudspeakers and thus determining a midpoint from which the position of the reference point is measured, it would be equally efficacious to measure the position of the reference point relative to each loudspeaker directly. The geometrical calculations would then be altered, but clearly within the competence of one skilled in the art.

It will also be understood that receivers could also be placed inside or around the dummy-head in the example described hereabove enabling calculation of the dummy head itself with respect to a known reference point.

We claim:

1. A method of determining the position of a plurality of microphones relative to a given reference point comprising the steps of:

transmitting, in response to at least one trigger signal from a processing device, sonic signals from each of a plurality of sonic signal generators situated at known positions with respect to the given reference point;

receiving the transmitted sonic signals at each of said plurality of microphones, each of said plurality of microphones generating corresponding electrical output signals;

conveying said electrical output signals from each of said plurality of microphones to the processing device;

utilizing in the processing device the electrical output signals and the said trigger signal to determine respective times-of-flight of the sonic signals from each of the said sonic signal generators to each of said plurality of microphones; and processing the times-of-flight together with data representative of the position of the given reference point relative to that of each of said sonic signal generators to generate indications of the distance and angular disposition of each of said plurality of microphones relative to the give reference point.

2. A method according to claim 1, wherein said given reference point is centered at an artificial head recording means.

3. A method according to claim 1, wherein each of the plurality of sonic signal generators comprises a loudspeaker.

4. A method according to claim 2, wherein said plurality of sonic signal generators comprise first and second loudspeakers positioned symmetrically either side of said artificial head recording means.

5. An audio recording apparatus including a plurality of microphones and an artificial head means, and means for determining the position of each of the plurality of microphones relative to the artificial head means, comprising:

a plurality of sonic signal generators situated at known positions with respect to said artificial head means, and a signal processing means linked to the sonic signal generators for causing said plurality of sonic signal generators to generate respective sonic signals, and the signal processing means being coupled to receive electrical output signals from the plurality of microphones produced in response to said sonic signals, said signal processing means being arranged to determine respective times-of-flight of the sonic signals from each of the plurality of sonic signal generators to each of the plurality of microphones, and to process such times-of-flight together with data representative of the position of each of the plurality of sonic signal generators relative to said artificial head means to generate indications of the distance and angular disposition of each microphone relative to the artificial head means.

6. An apparatus according to claim 5, wherein each of said sonic signal generators comprises a loudspeaker.

7. An apparatus according to claim 5, wherein said plurality of sonic signal generators comprise first and second loudspeakers positioned symmetrically either side of said artificial head recording means.

* * * * *